US009683294B2

(12) United States Patent
Kim et al.

(10) Patent No.: US 9,683,294 B2
(45) Date of Patent: Jun. 20, 2017

(54) CONVERSION COATING COMPOSITION, SURFACE TREATED STEEL SHEET, AND METHOD FOR MANUFACTURING THE SAME

(71) Applicant: POSCO, Pohang-si, Gyeongsangbuk-do (KR)

(72) Inventors: Yeon-Ho Kim, Gwangyang-si (KR); Young-Jin Kwak, Gwangyang-si (KR); Yon-Kyun Song, Gwangyang-si (KR); Yang-Ho Choi, Gwangyang-si (KR); Tae-Yeob Kim, Gwangyang-si (KR); Kyoung-Pil Ko, Gwangyang-si (KR); Chang-Hoon Choi, Gwangyang-si (KR); Jong-Sang Kim, Gwangyang-si (KR)

(73) Assignee: POSCO (KR)

( * ) Notice: Subject to any disclaimer, the term of this patent is extended or adjusted under 35 U.S.C. 154(b) by 201 days.

(21) Appl. No.: 14/367,714

(22) PCT Filed: Dec. 21, 2012

(86) PCT No.: PCT/KR2012/011329

§ 371 (c)(1),
(2) Date: Jun. 20, 2014

(87) PCT Pub. No.: WO2013/095072

PCT Pub. Date: Jun. 27, 2013

(65) Prior Publication Data

US 2015/0218705 A1 Aug. 6, 2015

(30) Foreign Application Priority Data

Dec. 23, 2011 (KR) ..... 10-2011-0141258

(51) Int. Cl.
*C23C 28/00* (2006.01)
*C23C 22/53* (2006.01)
(Continued)

(52) U.S. Cl.
CPC ..... *C23C 28/321* (2013.01); *C23C 2/26* (2013.01); *C23C 22/07* (2013.01); *C23C 22/44* (2013.01);
(Continued)

(58) Field of Classification Search
CPC ..... C23C 28/00; C23C 28/30; C23C 2/26; C23C 22/44; C23C 22/53; C23C 28/32; C23C 28/3225; Y10T 428/12799
See application file for complete search history.

(56) References Cited

U.S. PATENT DOCUMENTS

2005/0109426 A1 5/2005 Inoue et al.
2005/0282033 A1* 12/2005 Nakamaru ..... C23C 2/26 428/623

(Continued)

FOREIGN PATENT DOCUMENTS

CN 101258266 9/2008
CN 101809200 8/2010

(Continued)

OTHER PUBLICATIONS

English-language Extended European Search Report in counterpart European Application No. EP 12 680 428.7, mailed Jul. 31, 2015.

(Continued)

*Primary Examiner* — Humera Sheikh
*Assistant Examiner* — Lucas Wang
(74) *Attorney, Agent, or Firm* — Finnegan, Henderson, Farabow, Garrett & Dunner, LLP

(57) ABSTRACT

A conversion coating composition comprising 0.01 wt % to 0.2 wt % of phosphorous (P); 0.01 wt % to 0.2 wt % of magnesium (Mg); 0.005 wt % to 0.15 wt % of zirconium (Zr); 0.005 wt % to 0.15 wt % of titanium (Ti); 0.005 wt % to 0.15 wt % of vanadium (V); 0.05 wt % to 1 wt % of phenol resin; the balance of water and other unavoidable
(Continued)

impurities is provided. A surface treated steel sheet comprising a base steel sheet; a zinc or zinc alloy plated layer formed on the base steel sheet; a blackening layer formed on the zinc or zinc alloy plated layer; and an organic and inorganic complex conversion coating layer formed on the blackening layer, wherein the organic and inorganic complex conversion coating layer may satisfy the weight ratio of P:Mg:Zr:Ti:V=1:0.045 to 2:0.035 to 1.5:0.035 to 1.3:0.035 to 1.5 (based on the weight of P) is also provided. A method for manufacturing a steel sheet treated with the conversion coating composition is also provided.

19 Claims, 2 Drawing Sheets

(51) Int. Cl.

| | |
|---|---|
| ***C23C 2/06*** | (2006.01) |
| ***C23C 2/26*** | (2006.01) |
| ***C23C 22/73*** | (2006.01) |
| ***C23C 22/83*** | (2006.01) |
| ***C23C 22/44*** | (2006.01) |
| ***C23C 22/78*** | (2006.01) |
| ***C23C 22/07*** | (2006.01) |
| ***C23C 22/76*** | (2006.01) |
| ***C23C 30/00*** | (2006.01) |

(52) U.S. Cl.

CPC ..... *C23C 22/53* (2013.01); *C23C 22/73* (2013.01); *C23C 22/76* (2013.01); *C23C 22/78* (2013.01); *C23C 22/83* (2013.01); *C23C 28/00* (2013.01); *C23C 28/3225* (2013.01); *C23C 28/34* (2013.01); *C23C 28/345* (2013.01); *C23C 28/3455* (2013.01); *C23C 30/005* (2013.01); *Y10T 428/12535* (2015.01); *Y10T 428/12549* (2015.01)

(56) References Cited

U.S. PATENT DOCUMENTS

| | | | | |
|---|---|---|---|---|
| 2006/0063872 | A1* | 3/2006 | Teachout ..... | C09D 5/084 524/417 |
| 2007/0068602 | A1 | 3/2007 | Pemberton et al. | |
| 2007/0111021 | A1 | 5/2007 | Nakamura et al. | |
| 2007/0264522 | A1 | 11/2007 | Umebayashi et al. | |
| 2009/0032145 | A1 | 2/2009 | Diaddario, Jr. et al. | |
| 2010/0243465 | A1 | 9/2010 | Inbe et al. | |
| 2010/0273013 | A1 | 10/2010 | Jin et al. | |
| 2012/0145282 | A1* | 6/2012 | Kodama ..... | C23C 22/46 148/247 |
| 2012/0208043 | A1 | 8/2012 | Matsuda et al. | |

FOREIGN PATENT DOCUMENTS

| | | | |
|---|---|---|---|
| EP | 1852523 | | 11/2007 |
| EP | 2341164 | | 7/2011 |
| JP | 1986-291981 | A | 12/1986 |
| JP | 1987-263995 | A | 11/1987 |
| JP | 1987-290880 | A | 12/1987 |
| JP | 1988-161176 | A | 7/1988 |
| JP | 1989-056881 | A | 3/1989 |
| JP | 1990-093077 | A | 4/1990 |
| JP | 1990-282485 | A | 11/1990 |
| JP | 1994-346288 | A | 12/1994 |
| JP | 1995-143679 | | 6/1995 |
| JP | 2004-250787 | A | 9/2004 |
| JP | 2006-264297 | A | 10/2006 |
| JP | 2007-204847 | A | 8/2007 |
| JP | 2010-150626 | | 7/2010 |
| JP | 2011-106029 | | 2/2011 |
| JP | 2011-117070 | | 6/2011 |
| JP | 2011-219871 | | 11/2011 |
| JP | 2011-241482 | | 12/2011 |
| KR | 2002-0041602 | A | 6/2002 |
| KR | 2006-0073483 | A | 6/2006 |
| KR | 10-0845402 | B1 | 7/2008 |
| WO | WO 2006-043727 | | 4/2006 |
| WO | WO 2007-069783 | | 6/2007 |
| WO | WO 2009-002471 | | 12/2008 |
| WO | WO 2011-049238 | | 4/2011 |

OTHER PUBLICATIONS

First Office Action in Counterpart Chinese Patent Application No. 2012800640223,(issued May 19, 2015).

International Search Report for International Publication No. WO 2013/095072 A1 mailed Mar. 12, 2013.

* cited by examiner

CONVERSION COATING COMPOSITION, SURFACE TREATED STEEL SHEET, AND METHOD FOR MANUFACTURING THE SAME

TECHNICAL FIELD

The present invention relates to a surface treated steel sheet applied to home electronic appliances for display, home appliances, audio devices, office application (OA) devices, and the like, and a method for manufacturing the same.

BACKGROUND ART

Among surface treated steel sheets, a black steel sheet is a colored steel sheet with an inorganic black coating formed on a surface thereof through a blackening treatment. Since the black steel sheet enables customers to remove a painting process, it may reduce manufacturing costs, and also, since the black surface appearance thereof is uniform and reasonably attractive, the black steel sheet is widely used in various fields, such as home appliance, audio devices, OA devices, and vehicle components. A blackening treatment of a zinc plated steel sheet is mainly performed by an etching process, a cathode electrolysis process, an anode electrolysis process, or the like, and an inorganic blackened coating has microcracks or micropores formed in a surface thereof and is in a chemical form, such as an inorganic compound (e.g., metal oxide, metal hydroxide, or metal), particularly, in the form of metal oxide. The mechanism by which the inorganic blackened coating is tinged with black is explained by irregular reflection of incident light due to micropores and the absorption characteristics of visible light, depending on a metal oxide.

Such a black steel sheet has been manufactured by a method of forming a black coating through oxidation, an anode treatment or a conversion treatment with a zinc alloy plated steel sheet, mainly a Zn—Ni alloy plated steel sheet.

As a representative example, patent documents 1 and 2 disclose a method of forming a black coating on a zinc alloy plated steel sheet through oxidation with an acid aqueous solution containing metal ions, such as Ni, Co, Fe, Al, Mg, Cu, Sn, C, Cr, Mo, Ag, or the like. Also, patent documents 3 and 4 disclose a method of forming a black coating through an anode treatment of a general steel sheet or a surface treated steel sheet in an aqueous solution, and patent documents 5 and 6 disclose a method of forming a black coating through a conversion treatment of zinc or zinc alloy plated treated steel sheet in a solution containing metal ions.

Until the 1990s, blackening treatment methods using anode electrolysis, cathode electrolysis, conversion treatments, and the like were mainly developed, but in recent years, technological developments have been directed toward targets to add or enhance physical properties (e.g., processability, corrosion resistance, surface appearance, etc.). Patent documents 7 and 8 explain heat absorption and emission properties, conductance, electromagnetic wave shielding properties, and the like of black steel sheets which are subject to a blackening treatment and mainly use a Zn—Ni plated steel sheet having excellent blackened film adhesiveness as a base steel sheet. However, these related arts have a limitation, such as a rise in processing costs, as the black coating is formed by using an electrolytic process, such as an anode electrolytic process or a cathode electrolytic process, and also has a limitation that the occurrence of a serious powdering phenomenon in which the blackened film is broken or detached due to a lowering of adhesive force in spite of the conversion treatment of a zinc plated steel sheet.

Additionally, patent document 9 discloses a method of forming a black film on a zinc plated or a zinc alloy plated steel sheet by using a solution containing Sn and an Ni or Co compound, but in the case of the blackened film formed by this method, powdering is serious and thus adhesiveness of the blackened film is lowered. Also, in the case of a conversion treatment as above, since the reaction rate for forming the blackened film is generally slower than that in the electrolytic process, the conversion treatment is not suitable for working in combination with the electrical plating line operating in a high speed/continuous process and is also low in terms of productivity, compared with the electrolytic process. Further, patent document 10 discloses a method of blackening a steel sheet by reforming a surface film in a high temperature and high humidity atmosphere, but has a limitation in that the method is a continuous process needing a few tens of minutes of treatment time.

The blackened film may be formed by oxidizing a surface metal film by using a cathode electrolysis, an anode electrolysis, an oxidation, a conversion treatment, or the like, or substitution-precipitating a metal different from a base steel sheet. Since the foregoing methods lower corrosion resistance of the blackened film, a chromate treatment is performed to overcome such a limitation, but the enforcement of Cr control needs an alternative to such a control, and thus a conversion coating film suitable for a blackened film different from a conventional Cr-free blackened film is required.

PATENT DOCUMENTS (Patent document 1) Japanese Patent Application Laid-open Publication No. 1986-291981

(Patent document 2) Japanese Patent Application Laid-open Publication No. 1990-282485

(Patent document 3) Japanese Patent Application Laid-open Publication No. 1987-263995

(Patent document 4) Japanese Patent Application Laid-open Publication No. 1994-346288

(Patent document 5) Japanese Patent Application Laid-open Publication No. 1988-161176

(Patent document 6) Japanese Patent Application Laid-open Publication No. 1987-290880

(Patent document 7) Japanese Patent Application Laid-open Publication No. 2006-264297

(Patent document 8) Japanese Patent Application Laid-open Publication No. 2004-250787

(Patent document 9) Japanese Patent Application Laid-open Publication No. 1990-093077

(Patent document 10) Japanese Patent Application Laid-open Publication No. 1995-143679

DISCLOSURE OF INVENTION

Technical Problem

An aspect of the present invention provides a conversion coating composition, an environmentally-friendly surface treated steel sheet with superior corrosion resistance, adhesiveness of a blackened film, surface appearance (e.g., blackness and gloss), and enhanced productivity, and a method for manufacturing the same.

Solution to Problem

According to an aspect of the present invention, there is provided a conversion coating composition including: 0.01 wt % to 0.2 wt % of phosphorous (P); 0.01 wt % to 0.2 wt % of magnesium (Mg); 0.005 wt % to 0.15 wt % of zirconium (Zr); 0.005 wt % to 0.15 wt % of titanium (Ti); 0.005 wt % to 0.15 wt % of vanadium (V); 0.05 wt % to 1 wt % of phenol resin; the balance of water, and other unavoidable impurities.

According to another aspect of the present invention, there is provided a surface treated steel sheet including a base steel sheet; a zinc or zinc alloy plated film formed on the base steel sheet; a blackened film formed on the zinc or zinc alloy plated film; and an organic and inorganic composite conversion coating film formed on the blackened film, wherein the organic and inorganic composite conversion coating film satisfies the weight ratio of P:Mg:Zr:Ti:V=1:0.045 to 2:0.035 to 1.5:0.035 to 1.3:0.035 to 1.5 (based on P).

According to another aspect of the present invention, there is provided a method for manufacturing a surface treated steel sheet including: preparing a base steel sheet; forming a zinc or zinc alloy plated film on the base steel sheet; forming a blackened film on the zinc or zinc alloy plated film; and forming an organic and inorganic composite conversion coating film on the blackened film, wherein the organic and inorganic composite conversion coating film may be formed by a dipping or spraying method using a conversion coating solution including 0.01 wt % to 0.2 wt % of P; 0.01 wt % to 0.2 wt % of Mg; 0.005 wt % to 0.15 wt % of Zr; 0.005 wt % to 0.15 wt % of Ti; 0.005 wt % to 0.15 wt % of V; 0.05 wt % to 1 wt % of phenol resin; 10 wt % or less of additives; and the balance of water.

Advantageous Effects of Invention

According to an aspect of the present invention, since roll contamination due to powdering generated in the course of manufacturing a blackened film can be prevented by suppressing powdering generated during the blackening treatment to thus enhance adhesiveness of the blackened film, a continuous process can be conducted without frequent roll cleaning and roll exchanging, and the adhesiveness of a resin film in the coating of a resin, i.e., a post-process can be enhanced.

Also, in the present invention, a base steel sheet, for example, a plated steel sheet of which a plated film contains Zn and at least one element having a higher ionization tendency than Zn is blackened, thereby being capable of enhancing reactivity, compared with a conventional Zn plated steel sheet, and thus a high speed blackening treatment is made possible and productivity can be enhanced.

Further, by forming an organic and inorganic composite conversion coating film on the blackened film, low corrosion resistance of the blackened film consisting of two or more of metal/metal oxide/metal hydroxide can be enhanced. Furthermore, by securing corrosion resistance in the conversion coating film, freedom of a protection resin formed on the conversion coating film is increased, and thus all physical properties (processability, chemistry resistance, gloss, and the like) can be readily secured.

BRIEF DESCRIPTION OF DRAWINGS

The above and other aspects, features and other advantages of the present invention will be more clearly understood from the following detailed description taken in conjunction with the accompanying drawings, in which.

BEST MODE FOR CARRYING OUT THE INVENTION

Figure 1:
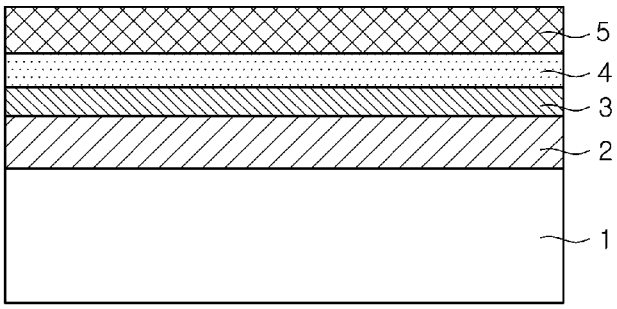
FIG. 1 is a schematic sectional view of a surface treated steel sheet according to an aspect of the present invention.
Figure 2:
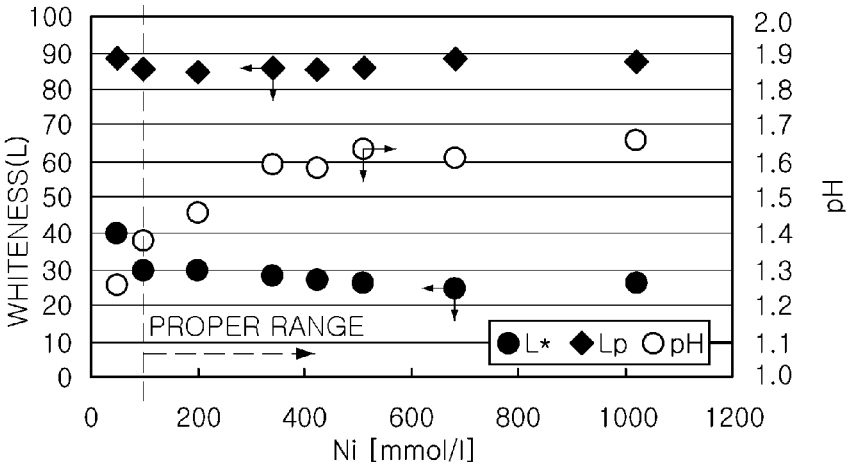
FIG. 2 is a graph showing surface appearance, powdering, and pH of a surface treated steel sheet according to the content of nickel.
Figure 3:
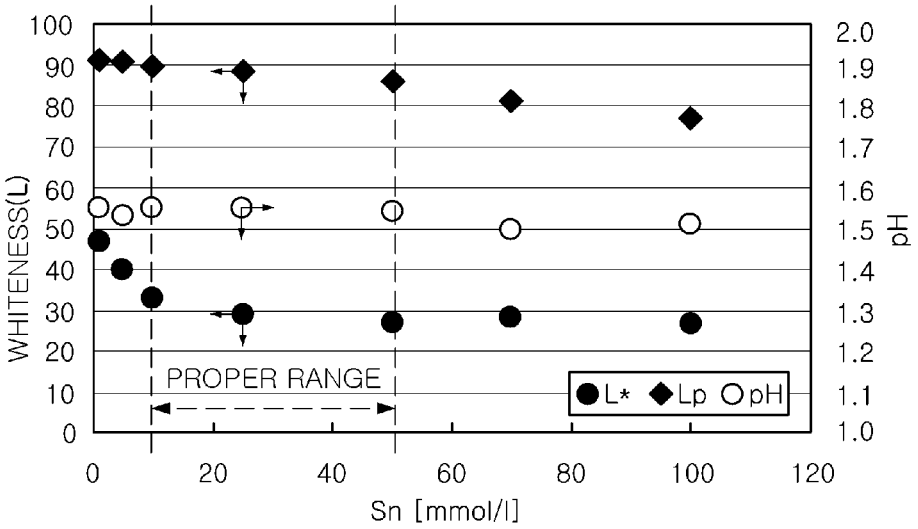
FIG. 3 is a graph showing surface appearance, powdering, and pH of a surface treated steel sheet according to the content of tin (Sn)
Figure 4:
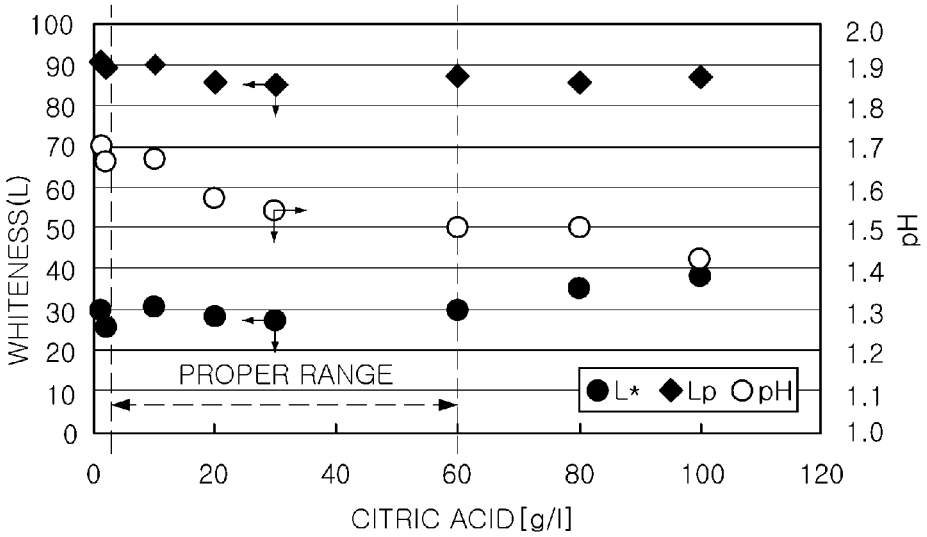
FIG. 4 is a graph showing surface appearance, powdering, and pH of a surface treated steel sheet according to the content of citric acid.

The inventors of the present invention perceived that the chemical form and surface structure of a blackened film act as important factors in maintaining superior surface appearance (blackness) and improving adhesiveness of the blackened film, and thus perceived that for such purposes, it is important to apply an appropriate solution and control process conditions for treatment. Also, in the blackening treatment, the inventors perceived that reactivity between a base steel sheet and a solution is important so as to enhance productivity, and thus perceived the importance of design of a plated film on the base material as a way to enhance the reactivity. Further, the inventors perceived that the formation and structure of a film by a reactive organic and inorganic composite conversion coating process are important, in that a barrier film capable of preventing or delaying penetration of corrosion factors should be coated on the entire surface of the base material without any exposure so as to enhance inferior corrosion resistance of the blackened film, and thus completed the present invention.

Hereinafter, a conversion coating composition according to an aspect of the present invention will be described in detail. The conversion coating composition may include a phosphorous (P) compound, a magnesium (Mg) compound, a zirconium (Zr) compound, a titanium (Ti) compound, a vanadium (V) compound, phenol resin, the balance of water, and other unavoidable impurities.

Phosphoric acid ion ($PO_4^{3-}$) introduced through the P compound forms phosphate on a blackened film. The formation of phosphate contributes to enhancement of corrosion resistance of the blackened film, and the P compound may be introduced in the form of a general salt, such as Na, K or the like, as well as the form of a phosphoric acid solution. It is preferable that the content of P introduced by the P compound is in a range of 0.01 wt % to 0.2 wt %. It is preferable that the content of P is limited to not less than 0.01 wt % or more so as to allow phosphate to be sufficiently formed on the blackened film and thus enhance corrosion resistance. Since saturation of enhancement effect of corrosion resistance and economical efficiency should be considered and an excessive adding of P causes precipitation due to formation of a compound with another composition to lower the solution stability, it is preferable that the content of P is limited to not more than 0.2 wt %.

By introducing the Mg compound, magnesium oxide (hydroxide) is formed in the conversion coating film. The magnesium oxide (hydroxide) contributes to enhancement of corrosion resistance of the blackened film, and the Mg compound may be introduced in the form of an inorganic salt with $F^-$, $Cl^-$, $OH^-$, $NO_3^-$, $SO_4^{2-}$, $CO_3^{2-}$, $ClO_4^-$, or $PO_4^{3-}$, or in the form of a salt with an ion of an organic acid, such as an acetic acid or the like. It is preferable that the content of Mg introduced by the Mg compound is in a range of 0.01 wt % to 0.2 wt %. To secure sufficient corrosion resistance, it is preferable that the content of Mg is limited to not less than 0.01 wt %. Since saturation of enhancement effect of corrosion resistance and economical efficiency should be considered and an excessive adding of Mg may increase free ions in the film to thus lower the corrosion resistance, it is preferable that the content of Mg is limited to not more than 0.2 wt %.

By the introduction of the Zr compound, Ti compound and V compound, an insulating oxide film is formed. The insulating oxide film contributes to the enhancement of corrosion resistance of the blackened film, and the Zr compound, Ti compound and V compound may be introduced in the form of a complex or salt with $F^-$, $Cl^-$, OR, $SO_4^{2-}$, and an organic oxide (e.g., organic butoxide, organic propoxide, organic ketone, etc.), or in the form of a complex or salt of an oxide, such as $MO_n$(M:Zr, Ti, V). It is preferable that the content of the metal introduced by the metal compound is in a range of 0.005 wt % to 0.15 wt %. To secure corrosion resistance through sufficient formation of the insulating oxide, it is preferable that the content of the metal is limited to not less than 0.005 wt %. On the other hand, since saturation of enhancement effect of corrosion resistance and economical efficiency should be considered and an excessive adding of the metal may increase free ions in the film to thus lower the corrosion resistance, it is preferable that the content of the metal is limited to not more than 0.15 wt %.

The phenol resin disperses metal components in the solution to stabilize the solution and forms an organic and inorganic composite film to increase densification of the conversion coating film, and thus contributes to enhancement of corrosion resistance. It is preferable that the phenol resin proposed by the present invention includes an amine group or one or more functional group of halogen elements (F, Cl, Br, and I) so as to increase the affinity with the metal, and has the following chemical formula.

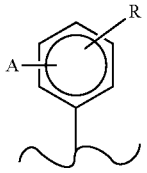

In the structure of the phenol resin, as the A functional group, one or more amine group selected from primary, secondary, tertiary, and quarternary amine groups may be combined with one or more carbon atom in the phenol ring, and one or more halogen element may be combined in the phenol ring at the middle or terminal of a polymer chain. The phenol resin may be used as a single polymer or as a copolymer and a mixture with other polymers. It is preferable that the content of the phenol resin is in a range of 0.05 wt % to 1 wt %. To secure corrosion resistance and contribute to solution stability, it is preferable that the content of the phenol resin is limited to not less than 0.05 wt %. However, since saturation of enhancement effect of corrosion resistance and economical efficiency should be considered and an excessive adding of the phenol resin may increase the viscosity of the solution to make it difficult to perform a dipping or spraying type conversion coating, it is preferable that the content of the phenol resin is limited to not more than 1 wt %.

As additives, an antifoaming agent, a neutralizing agent, and the like may be further added. The antifoaming agent is added to remove foam, the neutralizing agent is added to maintain the pH of the solution, and the antifoaming agent and the neutralizing agent have sufficient effects even though they are generally available products. However, it is preferable that the content of the additives does not exceed 10%. The reason is because an excessive adding of the additives increases the viscosity of the solution and is non-economical.

In the conversion coating composition according to an aspect of the present invention, the balance is water. However, since non-intended impurities may be unavoidably added from a raw material or surrounding environment in a typical manufacturing process, these unavoidable impurities are not excluded. Since these impurities are well known to those skilled in the art, all the contents are not particularly mentioned in the present description.

Hereinafter, a surface treated steel sheet according to another aspect of the present invention will be described in detail. The surface treated steel sheet includes a base steel sheet, a zinc or zinc alloy plated film formed on the base steel sheet, a blackened film formed on the zinc or zinc alloy plated film, and an organic and inorganic conversion coating film formed on the blackened film.

In the present invention, the base steel sheet is not particularly limited, and any base steel sheet as applied does not have an influence on the present invention.

In forming a zinc or zinc alloy plated film on the base steel sheet, the plated film may be a zinc plated film, and may include one or more element having a higher ionization tendency than Zn in order to achieve enhancement of productivity intended by the present invention. The reason the component system is controlled has a close relationship with the blackened film formed on the plated film. To form the blackened film, a blackening solution based on a chemical reaction that metal ions more noble than Zn contained in the blackening solution are precipitated by substitution with Zn is used. An element having a higher ionization tendency than Zn exhibits a substitution and precipitation reaction that is faster than that of Zn, and an alloy plated steel sheet of Zn and such an element exhibits a blackening reaction speed that is much faster than a pure Zn plated steel sheet, which leads to the enhancement of productivity. Examples of the element having a higher ionization tendency than Zn may generally include, but are not limited to, Mg, Al, and the like. A molten plating or dry coating (e.g., physical vapor deposition (PVD)) may be used to manufacture a plated steel sheet of which a plated film includes Zn and an element having a higher ionization tendency than Zn.

Also, although the content of the plated element is not limited, it is necessary to control the composition ratio of the constituent elements for the enhancement of productivity. Since the blackening reactivity varies with the content of the element having a higher ionization tendency than Zn, it is preferable that the content of the element is controlled in a range of 2 atom % to 55 atom %. To enhance the reactivity and the blackening speed, it is preferable that the content of the element having a higher ionization tendency than Zn is limited to not less than 2 atom %. However, in the case the content is excessive, an excessive reaction may occur, so that the adhesiveness of the blackened film is lowered, it fails to obtain uniform blackness, and economical efficiency may be lowered, and thus it is preferable that the content of the element having a higher ionization tendency than Zn is limited to not more than 55 atom %.

Also, in the surface treated steel sheet, the blackened film may be formed on the plated film. The composition of the blackened film and the size of precipitation particles have an influence on adhesiveness of the blackened film as well as surface appearance (e.g., blackness and gloss) of the black steel sheet. In the present invention, the blackened film formed by the substitution precipitation and oxidation mechanism may be in a mixture state of metal, metal oxide and metal hydroxide. If precipitated particles are too coarse, adhesiveness of the blackened film may be lowered, so that powdering may occur. So, it is preferable that the upper limit of the mean diameter of the particles is limited to 500 nm. In addition, if the particle size is too small, a sufficient black appearance cannot be obtained. So, it is preferable that the lower limit of the particle size is limited to 50 nm. Also, since the particle size determines the thickness of the blackened film, it is preferable that the thickness of the blackened film is within a range of 50 nm to 500 nm.

At this time, the metal may include one or more elements selected from the group consisting of Mg, Al, Zn, Fe, Ni, Co, Mn, Ti, Sn, Sb, and Cu, and is an important factor determining the surface appearance (blackness and gloss) of the surface treated steel sheet according to the present invention. Also, the composition of the blackened film may satisfy the following atomic ratios of Zn:M:O=1:0.01 to 0.065:0.1 to 0.5 (based on Zn). At this time, M may be one or more of the foregoing metal elements, and each metal element may be within an atomic ratio range 0.01 to 0.065. If the content of metal M is less than the lower limit of the atomic ratio range, surface appearance and blackness are deteriorated, and if the content of metal M exceeds the upper limit of the atomic ratio range, powdering may occur.

An organic and inorganic composite conversion coating film is formed on the blackened film. The organic and inorganic composite conversion coating film may enhance corrosion resistance of the surface treated steel sheet. It is preferable that the organic and inorganic composite conversion coating film is formed by the foregoing conversion coating solution.

It is preferable that Inorganic components of the organic and inorganic composite conversion coating film satisfies the following weight ratios of P:Mg:Zr:Ti:V=1:0.045 to 2:0.035 to 1.5:0.035 to 1.3:0.035 to 1.5 (based on the weight of P). The reason is because if the weight portion of each component is less than the lower limit, the formation of the conversion coating film is insufficient and thus the contribution to the corrosion resistance is immaterial, and if the weight ratio exceeds the upper limit, it does not exhibit a large difference in contribution to corrosion resistance and is not economical.

In the surface treated steel sheet according to an aspect of the present invention, the thickness of the organic and inorganic composite conversion coating film is not particularly limited. Since the increase in thickness enhances corrosion resistance, but lowers productivity, the thickness of the organic and inorganic composite conversion coating film is properly controlled in consideration of corrosion resistance and productivity.

Further, the surface treated steel sheet may further include a resin film on the organic and inorganic composite conversion coating film. The resin film may be a single film or a plurality of films. The resin film is formed as a protection coating of the black steel sheet. The type of resin is not particularly limited, but it is preferable that the resin film includes one or more selected from the group consisting of polyurethane resin, polyacryl resin, epoxy resin, phenoxy resin, and polyester resin. To form the resin film, the foregoing resins are available in a water soluble type or a solvent soluble type.

FIG. 1 is a schematic sectional view of a surface treated steel sheet according to an aspect of the present invention. A plated film 2 is formed on a base steel sheet 1, a blackened film 3 is formed on the plated film 2, an organic and inorganic composite conversion coating film 4 is formed on the blackened film 3, and a resin film 5 is formed on the organic and inorganic composite conversion coating film 4.

Hereinafter, a method for manufacturing a surface treated steel sheet according to another aspect of the present invention will be described in detail. A method for manufacturing a surface treated steel sheet includes: preparing a base steel sheet; forming a zinc or zinc alloy plated film on the base steel sheet; forming a blackened film on the zinc or zinc alloy plated film; and forming an organic and inorganic composite conversion coating film on the blackened film, wherein the organic and inorganic composite conversion coating film may be formed by a dipping or spraying method using a conversion coating solution including 0.01 wt % to 0.2 wt % of P; 0.01 wt % to 0.2 wt % of Mg; 0.005 wt % to 0.15 wt % of Zr; 0.005 wt % to 0.15 wt % of Ti; 0.005 wt % to 0.15 wt % of V; 0.05 wt % to 1 wt % of phenol resin; 10 wt % or less of additives; and the balance of water.

First, a base steel sheet is prepared. The base steel sheet is not particularly limited as aforementioned.

A zinc or zinc alloy plated film is formed on the prepared base steel sheet. While a pure Zn plated steel sheet may be used as the plated film, it is preferable that the plated film includes Zn and one or more element having a higher ionization tendency than Zn as aforementioned. At this time, it is difficult to alloy-plate the element having a higher ionization tendency than Zn at a high concentration via a conventional electrical plating method. Therefore, it is preferable that the plated film be formed by using a dry coating (e.g., PVD) or a molten zinc plating rather than the electrical plating.

Next, a blackened film is formed on the plated film. A blackening solution will be described later. The blackened film may be formed via conversion coating (e.g., dipping, spraying, etc.) of the blackening solution.

The blackening solution may include an organic acid, inorganic acid ions, surface modifier, and the balance of water. The components of the blackening solution have a close relationship with the components, chemical structure and surface structure of the blackened film, and thus it is necessary to properly design the components of the blackening solution and set the content range.

The metal ion includes one or more selected from the group consisting of Mg, Al, Zn, Fe, Ni, Co, Mn, and Ti, and it is preferable that the content of the metal ion is controlled to be within a range of 100 mmol/L to 1500 mmol/L. Also, the metal ion includes one or more selected from the group consisting of Sn, Sb, and Cu, and it is preferable that the content of the metal ion is controlled to be within a range of 10 mmol/L to 50 mmol/L. By controlling the content of the metal ion within the range, the surface appearance and blackness of the black steel sheet can be enhanced, and the upper limit of each component may be limited in consideration of economical efficiency. It is preferable that the contents of Sn, Sb, and Cu is limited to not more than 50 mmol/L in order to prevent powdering.

Also, the blackening solution may include an organic acid. The organic acid is included as a solution stabilizer (i.e., complex agent) and to secure uniform surface appearance. Preferably, the organic acid is included 2 g/L or more in order to enhance complex force, prevent precipitation of metal ions, and stabilize the solution. Also, if the organic acid exceeds 60 g/L, a complex with metal ions is excessively formed to hinder precipitation of a metal oxide, which results in bad surface appearance (blackness). Preferably, the organic acid may include one or more selected from the group consisting of acetic acid, citric acid, tartaric acid, malic acid, oxalic acid, phthalic acid and maleic acid.

Also, the blackening solution may include an inorganic acid. The inorganic acid is added in the blackening so as to promote oxidation and secure solution stability. It is preferable that the inorganic acid is added to control the pH of the blackening solution within a range of 1.0 to 4.0. Since strong oxidation power may dissolve the plated film rather than forms the blackened film, it is preferable that the inorganic acid is included to control pH of the blackening solution to not less than 1.0. When oxidation power is excessively low, reactivity may be weakened, and metal ions may be hydrolyzed to generate precipitation, thus lowering solution stability. Therefore, it is preferable that the inorganic acid is included to control pH of the blackening solution to not more than 4.0. Preferably, the inorganic acid may include one or more selected from the group consisting of $NO_3^-$, $SO_4^{2-}$, $PO_4^{3-}$, $Cl^-$, $ClO_3^-$ and $ClO_4^-$.

Also, the blackening solution may include a surface modifier. The surface modifier may control component and size of precipitation particles in the blackened film. The content of the surface modifier may be controlled to be different depending on the type of the surface modifier, but it is preferable that the size of the blackened particles precipitated by using the surface modifier is limited to not more than 500 nm. It is also preferable that the surface modifier includes one or more selected from the group consisting of an amine complex agent, a polyamine complex agent, a polyol complex agent, polyalcohol complex agent, and an oxidizer.

In the blackening solution according to an aspect of the present invention, the balance is water. However, since non-intended impurities may be unavoidably added from the raw material or surrounding environment in a typical manufacturing process, these unavoidable impurities are not excluded. Since these impurities are well known to those skilled in the art, all the contents are not particularly mentioned in the present description.

An organic and inorganic composite conversion coating film is formed on the blackened film. The conversion coating film may be formed as a single layer or a plurality of layers. Also, as mentioned above, it is preferable that the organic and inorganic composite conversion coating film is formed by a general conversion coating, such as a dipping or spraying.

Further, a resin film may be further formed on the organic and inorganic composite conversion coating film. The method of forming the resin film is not particularly limited, and any method may be used if it can form the resin film. The resin film may be formed as a single layer or a plurality of layers, and although the resin film is formed in a multilayer, the manufacturing method thereof is not particularly limited.

Hereinafter, the present invention will be described in more detail with examples thereof. It is noted that the following examples should be not construed to limit the scope of the present invention, but rather are only exemplarily provided to describe the present invention in more detail. Thus, the scope of the present invention is to be determined by the matters set forth in the following claims and matters analogized reasonably therefrom.

EXAMPLES

Zn and another element Mg having a higher ionization tendency than Zn were selected, and the content ratios thereof were controlled as indicated in table 1. A Zn—Mg plated steel sheet was manufactured by a dry coating (e.g., PVD), in which the coating amount of a plated film was controlled to 10 g/m$^2$. The Zn—Mg plated steel sheet was dipped for 2 seconds at 40° C. in a blackening solution having a composition ratio proposed by the present invention to form a blackened film on the Zn—Mg plated steel sheet.

Surface appearance (whiteness), gloss, and powdering of the surface treated steel sheet manufactured by the above manufacturing method were measured, and measurement results were shown in the following table 1.

Surface appearance, i.e., whiteness (L*) was measured by a color-difference meter, and as the measured whiteness value is close to zero, blackness rises. Also, powdering evaluation was performed by observing blackened particles (i.e., powder) detached from an adhesive surface when strongly attaching the adhesive surface of a cellophane tape on the blackened film and then detaching the cellophane tape. To quantify powdering characteristics, whiteness (Lp) of the powdering portion was measured by using a color-difference meter. It is meant that as the measured value is close to 89 that is an Lp value of a sample which is not subject to the taping test, occurrence of powdering is low. Gloss was measured at an incident angle of 60 degrees by using a gloss meter.

TABLE 1

| | Zn—Mg composition ratio (atom %) | | Evaluation results of black steel sheets | | |
|---|---|---|---|---|---|
| | | | Surface appearance | Powdering | |
| Item | Zn | Mg | (L*) | (Lp) | Gloss |
| (Comparative Example 1) | 40 | 60 | 24.3 | 79.7 | 18.6 |
| (Comparative Example 2) | 43 | 57 | 23.8 | 84.3 | 19.7 |
| Inventive Example 1 | 45 | 55 | 25.5 | 87.9 | 17.2 |
| Inventive Example 2 | 60 | 40 | 26.7 | 88.6 | 18.5 |
| Inventive Example 3 | 80 | 20 | 27.5 | 89.5 | 20.5 |
| Inventive Example 4 | 98 | 2 | 30.1 | 88.7 | 17.1 |
| (Comparative Example 3) | 99 | 1 | 35.9 | 89.2 | 17.3 |

As indicated in table 1, it was confirmed that inventive examples 1 to 4 satisfying the composition ratio of the plated film according to the present invention do not have any problem in surface appearance (blackness) and powdering, and have excellent gloss. Also, it was confirmed that the treatment speed was enhanced twice or more than that of a pure Zn-treated steel sheet.

On the other hand, since the contents of Mg in comparative examples 1 and 2 were more than the content of Mg controlled by the present invention, it was confirmed that adhesiveness of the blackened film was lowered due to an excessive reaction. Since the content of Mg in comparative example 3 was less than that controlled by the present invention, it was confirmed that reactivity was lowered, and thus blackening speed was very low, and blackness was not good.

Example 2

A Zn—Mg alloy plated steel sheet (Zn:MG (atom %)=60:40, plating amount 10 g/m$^2$) as a base steel sheet was dipped for 2 seconds at 40° C. in a blackening solution to form a blackened film. The blackening solution includes Ni and Sn as metal ions, and further includes citric acid, sulfuric acid, and a surface modifier as additives.

(1) A blackening solution including 25 mmol/L Sn, 10 g/L citric acid, 2 g/L sulfuric acid, and 1 g/L surface modifier was used, and the content of Ni was controlled to be within a range of 50 mmol/L to 1022 mmol/L. Surface appearance (L*) of black steel sheets and whiteness (Lp) and pH of powdering portions depending on the content of Ni were evaluated and then indicated in table 2. The evaluation method was the same as that in Example 1.

As indicated in table 2, when the content of Ni was in a range of 100 mmol/L to 1500 mmol/L, surface appearance, powdering and pH satisfied the range intended by the present invention. By maintaining a proper pH range, it was confirmed that solution stability was secured without precipitation or floating matter.

(2) A blackening solution including 500 mmol/L Ni, 10 g/L citric acid, 2 g/L sulfuric acid, and 1 g/L surface modifier was used, and the content of Sn was controlled to be within a range of 1 mmol/L to 100 mmol/L. Surface appearance (L*) of black steel sheets and whiteness (Lp) and pH of powdering portions depending on the content of Ni were evaluated and then indicated in table 3. The evaluation method was the same as that in Example 1.

As indicated in table 3, when the content of Sn was in a range of 10 mmol/L to 50 mmol/L, surface appearance, powdering and pH satisfied the range intended by the present invention. By maintaining a proper pH range, it was confirmed that solution stability was secured without precipitation or a floating matter.

(3) A blackening solution including 500 mmol/L Ni, 25 mmol/L Sn, 2 g/L sulfuric acid, and 1 g/L surface modifier was used, and the content of citric acid was controlled to be within a range of 1-100 mmol/L. Surface appearance (L*) of black steel sheets and whiteness (Lp) and pH of powdering portions depending on the content of citric acid were evaluated and then indicated in table 4. The evaluation method was the same as that in Example 1.

As indicated in table 4, when the content of citric acid was in a range of 2 gl/L to 60 gl/L, surface appearance, powdering and pH satisfied the range intended by the present invention. By maintaining a proper pH range, it was confirmed that solution stability was secured without precipitation or a floating matter.

(4) A blackening solution including 500 mmol/L Ni, 25 mmol/L Sn, 10 g/L citric acid, and 2 g/L sulfuric acid, and a blackening solution further including 1 g/L surface modifier were used, and surface appearance (L*) and powdering were evaluated. The evaluation method was the same as that in Example 1.

Regardless of adding of the surface modifier, surface appearance (L*) exhibited excellent blackness, but when the surface modifier was not added, serious powdering was generated, and it was confirmed that the blackened film included coarse particles having a size more than 500 nm. Also, it was confirmed that when the surface modifier was added, the precipitated particles in the blackened film had a size less than 500 nm and powdering was not generated.

Example 3

A Zn—Mg alloy plated steel sheet (Zn:MG (atom %)=60:40, plating amount 10 g/m2) as a base steel sheet was dipped for 2 seconds at 40 C in a blackening solution (500 mmol/L Ni, 25 mmol/L Sn, 10 g/L citric acid, 2 g/L sulfuric acid, and 1 g/L surface modifier) to form a blackened film. Afterwards, the Zn—Mg alloy plated steel sheet formed with the blackened film was dipped in a conversion coating solution having the composition indicated in table 2 to form an organic and inorganic composite conversion coating film on the blackened film, and then a polyurethane protection resin was coated 2 μm thick and corrosion resistance was evaluated. Corrosion resistance was performed by Salt Spray Test (SST) according to JIS E2731 standards, and 72 hours later, occurrence of white rust was visually determined and then indicated in table 2. No occurrence of white rust was indicated by "○" occurrence of white rust less than 5% by "Δ" and occurrence of white rust not less than 5% by "X".

TABLE 2

| Corrosion resistanceEvaluation | Composition content (wt %) | | | | | | |
|---|---|---|---|---|---|---|---|
| | Element content in solution | | | | | Phenol resin | SST |
| | P | Mg | Zr | Ti | V | | |
| (Comparative Example 4) | 0 | 0 | 0 | 0 | 0 | 0 | X |
| (Comparative Example 5) | 0.005 | 0.05 | 0.05 | 0.05 | 0.05 | 0.3 | X |
| (Comparative Example 6) | 0.03 | 0.005 | 0.05 | 0.05 | 0.05 | 0.5 | X |
| (Comparative Example 7) | 0.03 | 0.05 | 0.001 | 0.001 | 0.001 | 0.3 | X |
| (Comparative Example 8) | 0.05 | 0.05 | 0.05 | 0.05 | 0.05 | 0.01 | X |
| Inventive Example 5 | 0.01 | 0.1 | 0.005 | 0.03 | 0.05 | 0.3 | Δ |
| Inventive Example 6 | 0.03 | 0.07 | 0.03 | 0.03 | 0.03 | 0.5 | Δ |
| Inventive Example 7 | 0.07 | 0.05 | 0.05 | 0.05 | 0.05 | 0.3 | ○ |
| Inventive Example 8 | 0.1 | 0.03 | 0.03 | 0.005 | 0.005 | 0.3 | Δ |
| Inventive Example 9 | 0.1 | 0.01 | 0.15 | 0.03 | 0.02 | 0.05 | ○ |
| Inventive Example 10 | 0.2 | 0.2 | 0.03 | 0.03 | 0.03 | 0.2 | ○ |
| Inventive Example 11 | 0.05 | 0.05 | 0.03 | 0.15 | 0.15 | 0.3 | Δ |
| (Comparative Example 9) | 0.03 | 0.5 | 0.2 | 0.05 | 0.05 | 0.3 | X |
| (Comparative Example 10) | 0.05 | 0.1 | 0.3 | 0.3 | 0.3 | 0.3 | X |

As indicated in table 2, it was confirmed that inventive examples 5 to 11 satisfying the composition ratio of the organic and inorganic composite conversion coating solution controllable by the present invention had corrosion resistance less than 5% in 72 hours SST, and the conversion coating film had a composition ratio of P:Mg:Zr:Ti:V=1:0.045 to 2:0.035 to 1.5:0.035 to 1.3:0.035 to 1.5 (weight ratios based on P).

On the other hand, it was confirmed that since comparative examples 5 to 8 had the contents of respective elements in solution less than the contents of elements controllable by the present invention, the conversion coating film was insufficiently formed, and thus corrosion resistance was lowered. Also, it was confirmed that since comparative examples 9 and 10 had the contents of Mg, Zr, Ti, and V more than the contents controllable by the present invention, corrosion resistance was lowered.

DESCRIPTION OF SYMBOLS IN DRAWINGS

1: Base steel sheet
2: Plated film

3: Blackened film
4: Organic and inorganic conversion coating film
5: Resin film

The invention claimed is:

1. A surface treated steel sheet comprising:
a base steel sheet;
a zinc or zinc alloy plated layer formed on the base steel sheet;
a blackened film formed on the zinc or zinc alloy plated layer; and
an organic and inorganic composite conversion coating film formed on the blackened film,
wherein the organic and inorganic composite conversion coating film satisfies the weight ratio of P:Mg:Zr:Ti:V=1:0.045-2:0.035-1.5:0.035-1.3:0.035-1.5 (based on P),
wherein the blackened film satisfies the atomic ratios of Zn:M:O=1:0.01-0.065: 0.1-0.5 (based on atomic Zn), and
where M is one or more element selected from the group consisting of Mg, Al, Zn, Fe, Ni, Co, Mn, Ti, Sn, Sb, and Cu.

2. The surface treated steel sheet of claim 1, wherein the plated film is 1) a Zn plated film or 2) a plated film comprising Zn and an element having a higher ionization tendency than Zn.

3. The surface treated steel sheet of claim 2, wherein the content of the element having a higher ionization tendency is in a range of 2 to 55 atom %.

4. The surface treated steel sheet of claim 1, wherein the blackened film is 50 nm to 500 nm thick.

5. The surface treated steel sheet of claim 1, wherein metal oxide particles precipitated in the blackened film have an average diameter ranging from 50 nm to 500 nm.

6. The surface treated steel sheet of claim 1, further comprising a resin film on the organic and inorganic composite conversion coating film.

7. The surface treated steel sheet of claim 6, wherein the resin film comprises one or more selected from the group consisting of polyurethane resin, polyacryl resin, epoxy resin, phenoxy resin, and polyester resin.

8. The surface treated steel sheet of claim 1, wherein the organic and inorganic composite conversion coating film is composed of a conversion coating composition comprising 0.01 wt % to 0.2 wt % of phosphorous (P); 0.01 wt % to 0.2 wt % of magnesium (Mg); 0.005 wt % to 0.15 wt % of zirconium (Zr); 0.005 wt % to 0.15 wt % of titanium (Ti); 0.005 wt % to 0.15 wt % of vanadium (V); 0.05 wt % to 1 wt % of phenol resin; the balance of water, and other unavoidable impurities.

9. The surface treated steel sheet of claim 8, wherein the conversion coating composition further comprising at least one of an antifoaming agent and a neutralizing agent to not more than 10 wt %.

10. The surface treated steel sheet of claim 8, wherein the phenol resin comprises one or more functional group of halogen elements (F, Cl, Br, and I) or an amine group.

11. The surface treated steel sheet of claim 8, wherein the phenol resin comprises one or more amine group selected from primary, secondary, tertiary and quaternary amine groups which are combined with one or more carbon atom, and one or more halogen element is combined at the middle or terminal of a polymer chain.

12. A method for manufacturing a surface treated steel sheet according to claim 5 comprising:
preparing a base steel sheet; forming a zinc or zinc alloy plated film on the base steel sheet;
forming a blackened film on the zinc or zinc alloy plated film; and
forming an organic and inorganic composite conversion coating film on the blackened film,
wherein the organic and inorganic composite conversion coating film is formed by a dipping or spraying method using a conversion coating composition including 0.01 wt % to 0.2 wt % of P; 0.01 wt % to 0.2 wt % of Mg; 0.005 wt % to 0.15 wt % of Zr; 0.005wt % to 0.15 wt % of Ti; 0.005 wt % to 0.15 wt % of V; 0.05 wt % to 1 wt % of phenol resin; 10 wt % or less of additives; and the balance of water.

13. The method of claim 12, wherein the blackened film is formed by using a blackening solution comprising a metal ion, an organic acid, an inorganic acid ion, a surface modifier, and the balance of water.

14. The method of claim 13, wherein the metal ion comprises 100 mmol/L to 1500 mmol/L one or more metal ion selected from the group consisting of Mg, Al, Zn, Fe, Ni, Co, Mn, and Ti, and 10 mmol/L to 50 mmol/L one or more selected from the group consisting of Sn, Sb, and Cu.

15. The method of claim 13, wherein the organic acid comprises one or more selected from the group consisting of acetic acid, citric acid, tartaric acid, malic acid, oxalic acid, phthalic acid and maleic acid, and the content of the organic acid is in a range of 2-60 g/L.

16. The method of claim 13, wherein the inorganic ion comprises one or more selected from the group consisting of $NO_3^-$, $SO_4^{2-}$, $PO_4^{3-}$, $Cl^-$, $ClO_3^-$, and $ClO_4^-$such that pH of the blackening solution is in a range of 1.0 to 4.0.

17. The method of claim 13, wherein the surface modifier comprises one or more selected from the group consisting of an amine complex agent, a polyamine complex agent, a polyol complex agent, polyalcohol complex agent, and an oxidizer.

18. The method of claim 12, wherein the blackening solution has a pH range of 1.0 to 4.0.

19. The method of claim 12, after the forming of the organic and inorganic composite conversion coating film, further forming a resin film on the organic and inorganic composite conversion coating film.

* * * * *